US009424703B2

(12) United States Patent
Baudat et al.

(10) Patent No.: US 9,424,703 B2
(45) Date of Patent: Aug. 23, 2016

(54) SYSTEM TO CLASSIFY AN ITEM OF VALUE

(71) Applicant: MEI, Inc., Malvern, PA (US)

(72) Inventors: Gaston Baudat, Glenmoore, PA (US); Mustafa Emresoy, Philadelphia, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 14/438,588

(22) PCT Filed: Oct. 4, 2013

(86) PCT No.: PCT/US2013/063413

§ 371 (c)(1),
(2) Date: Apr. 24, 2015

(87) PCT Pub. No.: WO2014/066014

PCT Pub. Date: May 1, 2014

(65) Prior Publication Data

US 2015/0287259 A1 Oct. 8, 2015

Related U.S. Application Data

(60) Provisional application No. 61/718,274, filed on Oct. 25, 2012.

(51) Int. Cl.

| | |
|---|---|
| ***G07D 7/00*** | (2016.01) |
| ***G07D 5/00*** | (2006.01) |
| ***G07D 5/08*** | (2006.01) |

(52) U.S. Cl.

CPC .. *G07D 5/00* (2013.01); *G07D 5/08* (2013.01); *G07D 7/00* (2013.01)

(58) Field of Classification Search

CPC ..... G07D 5/00; G07D 5/08; G07D 7/00
USPC ..... 194/302
See application file for complete search history.

(56) References Cited

U.S. PATENT DOCUMENTS

2009/0101469 A1* 4/2009 Baudat ..... G01B 7/06 194/317

FOREIGN PATENT DOCUMENTS

WO WO 2011/128881 A2 10/2011
WO WO-2011/128881 A2 * 10/2011 ..... H03D 3/00

OTHER PUBLICATIONS

International Search Report dated Mar. 1, 2014 in connection with International Patent Application No. PCT/US2013/063413, 3 pages.
Written Opinion of International Searching Authority dated Mar. 1, 2014 in connection with International Patent Application No. PCT/US2013/063413, 6 pages.

* cited by examiner

*Primary Examiner* — Mark Beauchaine

(57) ABSTRACT

A handling apparatus comprising an offset sampling module and a digital processing module is described herein. The offset sampling module is configured to provide a sampled signal by sampling at least one signal at a sampling frequency that is offset from a fundamental frequency of the signal by an offset factor; and the digital processing module configured to convert the sampled signal into a frequency domain signal. The handling apparatus further includes an authentication module to determine at least one characteristic property based at least on the frequency domain signal; and to classify the inserted item of value based on the determination.

39 Claims, 5 Drawing Sheets

SYSTEM TO CLASSIFY AN ITEM OF VALUE

CROSS-REFERANCE TO RELATED APPLICATION(S)

The present application claims priority under 35 U.S.C. §365 to International Patent Application No. PCT/US 2013/063413 filed Oct. 4,2013, entitled "SYSTEM TO CLASSIFY AN ITEM OF VALUE", and, through International Patent Application No. PCT/US2013/063413,to United States Provisional Application No. 61/718,274 filed Oct. 25, 2012, which are incorporated herein by reference into present disclosure as if fully set forth herein.

TECHNICAL FIELD

The present subject matter relates, in general, to classifying an item of value for recognition and validation and, in particular, to a method and a system to classify items of value, such as coins, tokens, banknotes, bills, valuable papers, security documents, currency, etc., inserted into an electronic transaction system, for example, currency validators, pay phones, automatic teller machines, gaming machine, and vending machines.

BACKGROUND

Typically, electronic transaction systems, such as vending machines, electronic gaming devices, and other electronic acceptors, include discriminators to determine the authenticity of one or more inserted items of value, for example, coins. Additionally, the discriminators may be used for recognition, to determine the content or denomination of the item of value. Typically, the discriminators measure one or more properties of the items of value, such as dimensions, conductivity, and magnetic permeability, for authentication and/or recognition purposes. Such discriminators may include one or more sensors to measure properties of the coins. Examples of sensors include optical, acoustic, impact and electromagnetic sensors.

Electromagnetic sensors, for example, are operated to induce eddy currents in a coin, and obtain a response of how the magnetic field varies due to the presence of a coin. Responses measured by the electromagnetic sensors can be related to properties of the coin. In another example, the electromagnetic sensor can obtain a response of how the magnetic field varies due to the presence of inks, which are printed on banknotes and are known to exhibit electromagnetic properties.

The responses may be in the form of sensor output signals, which are typically modeled either by time domain or by frequency domain techniques for determining properties of the inserted item of value. The time domain techniques can be very sensitive to variations from unit to unit. Additionally, the time domain techniques are known to be computationally intensive and complex. Time and frequency domain techniques also introduce considerable quantization noise and aliasing in the signals, which may corrupt results of the sensor. One solution for reducing the quantization noise and aliasing is to sample the signal at a sampling rate that is substantially higher than the Nyquist rate. However, this solution comes at the expense of system complexity. Alternatively, the quantization noise can be reduced by band-limiting the signal via filtering. However, additional cost is associated with a high order anti-aliasing filter. Therefore, there exists a need for lower cost and reduced complexity means for determining properties of the inserted item of value.

SUMMARY

This summary is provided to introduce concepts related to a system and method to classify one or more items of value. The concepts are further described below in the detailed description, drawings and claims. This summary is not intended to identify essential features of the claimed subject matter nor is it intended for use in determining or limiting the scope of the claimed subject matter.

Computer program products are also described that comprise non-transitory computer readable media storing instructions, which when executed by at least one data processors of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

In one aspect, a handling apparatus includes an offset sampling module and a digital processing module. The offset sampling module is configured to provide a sampled signal by sampling at least one input signal at a sampling frequency. The sampling frequency is offset from a fundamental frequency of the input signal by an offset factor. The digital processing module is configured to convert the sampled signal into a frequency domain signal.

In another aspect, a method includes sampling at least one signal at a sampling frequency and transforming the sampled signal into a frequency domain signal. The sampling frequency is offset from a fundamental frequency of the signal by an offset factor.

In yet another aspect, a method includes determining an aliasing profile. A level of aliasing acceptable in an application is determined from the aliasing profile. An aliasing factor is determined based on the level of acceptable aliasing. An input signal is sampled at a sampling frequency. The sampling frequency being offset from a fundamental frequency of the input signal by an offset factor. The offset factor being based at least on the aliasing factor. The sampled input signal is converted into a frequency domain signal.

One or more of the following features can be included. For example, the signal can be at least one of a drive signal and a sensor output signal. The drive signal can be a periodic signal with predetermined buffer time intervals to reach a steady state. The item of value can be at least one of a banknote, a bill, a coupon, a security paper, a check, a valuable document, a coin, a token, and a gaming chip.

The handling apparatus can include at least one sensor. The sensor can be configured to receive the drive signal and provide the sensor output signal in response to an item of value inserted into the handling apparatus.

The handling apparatus can further include an authentication module. The authentication module can be configured to determine at least one characteristic property of an inserted item of value based at least on the frequency domain signal and classify the inserted item of value based on the determination. The authentication module can be configured to implement one of Mahalanobis distance, Feature Vector Selection, and Linear Discriminant Analysis to classify the inserted item of value. The authentication module can be configured to perform curve fitting on the frequency domain signal. The authentication module can be configured to obtain at least one of electrical impedance, resistance and inductance based on the frequency domain signal. The authentication module can be configured to model at least one of the electrical impedance, the resistance, and the inductance to provide a transfer function. The transfer function can be used to classify the inserted item of value. The authentication module can be configured to provide a transfer function and evaluate the transfer function at selected frequency points to classify the item of value.

The handling apparatus can include an anti-aliasing module to condition the signal. The anti-aliasing module can include at least one filter. The complexity of the filter can be configured based at least on a processor and an application of the handling apparatus. The offset factor can be selected such that a first overlapping spectral repetition occurs at a point defined by an aliasing factor and the sampling frequency. The sampling frequency can be based at least on the aliasing factor and a clock period of the processor. The aliasing factor can be based at least on an aliasing profile and a measure of aliasing acceptable to an application.

The current subject matter can be implemented in one of a vending machine, an automatic teller machine, a gaming machine, a currency validator, and a bill validator. The current subject matter can be implemented in one of a pay phone, a computer, and a hand-held device.

The handling apparatus can include a drive signal module to configure one or more properties of the drive signal, wherein the properties are periodicity, number of pulses in each second, and pulse width.

The drive signal can be provided to a sensor. The sensor output signal can be obtained in response to the drive signal and an item of value inserted into a handling apparatus. At least one of the sensor output signal and the drive signal can be conditioned. At least one characteristic property of an inserted item of value can be determined from the frequency domain signal. The property can be differential impedance determined based on a difference between an impedance in presence of the inserted item of value and an impedance in absence of the inserted item of value. The inserted item of value can be classified for one of authentication, recognition, testing, recognition, verification, validation, and determination of value of the item of value. A curve fitting technique can be implemented to classify the inserted the item of value. A transfer function model can be obtained to classify the inserted item of value.

The transfer function model can be evaluated at specified frequency points to classify the inserted item of value. The transfer function model can be obtained by one of a vector fitting technique and Levy's curve-fitting method. The offset factor can be selected such that a first overlapping spectral repetition occurs at a point defined by an aliasing factor and the sampling frequency. The aliasing factor can be based at least on an aliasing profile and a measure of aliasing acceptable in an application.

The frequency domain signal can be used to provide a transfer function model. A curve fitting technique can be implemented on the frequency domain signal to reduce signal to noise ratio.

A system can implement the methods described herein.

The subject matter described herein provides many advantages. For example, mitigating the negative effects of aliasing can be achieved in applications where high-order filtering, high-speed ADCs, and/or oversampling are either cost-prohibitive or not commonly available. By reducing errors introduced by aliasing, cost and complexity of the current subject matter can be reduced. Additionally, transition band requirements of anti-aliasing filters can be reduced, enabling relatively low order filters to achieve similar performance and lower cost than conventional solutions.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components. For simplicity and clarity of illustration, elements in the figures are not necessarily to scale.

DETAILED DESCRIPTION

Figure 1:
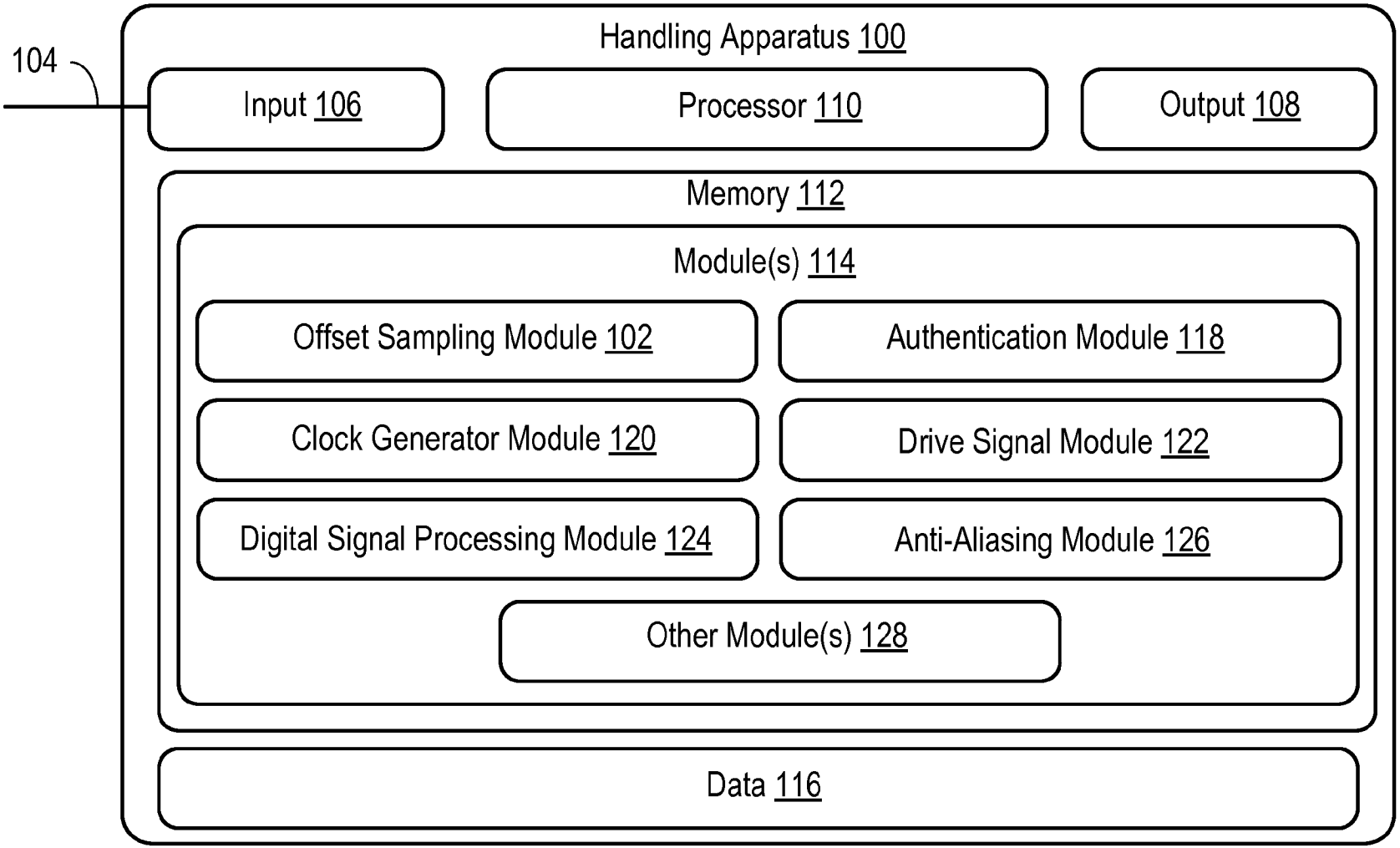
FIG. 1 illustrates an exemplary handling system for classifying at least one item of value, in accordance with an embodiment of the present subject matter.

A handling apparatus configured to determine authenticity and validity of one or more items of value is disclosed herein. Examples of an item of value include, but are not limited to, banknotes, bills, coupons, security papers, checks, valuable documents, coins, tokens, and gaming chips. The handling apparatus can be implemented within any electronic transaction system, such as a vending machine, a gaming machine, an automatic teller machine, a pay phone, etc., and in general any equipment used in retail, gaming, or banking industry for sorting and evaluation of the item of value such as a computer, a hand-held device, etc.

The handling apparatus, according to an embodiment, can include at least one sensor, for example an electromagnetic sensor, driven by a drive signal. The drive signal is a periodic signal, which may have predetermined buffer time intervals to ensure steady state operation. When an item of value is inserted into the handling apparatus, the item of value comes in contact with the sensor to generate at least one sensor output signal. The sensor output signal includes information pertinent to classification of the inserted item of value. Classification of the item of value includes, but is not limited to, recognition, verification, validation, authentication, non-destructive testing, and determination of value or denomination of the item of value.

In one implementation, the handling apparatus includes an offset sampling module to sample the sensor output signal and the drive signal at a sampling frequency offset from their respective fundamental frequencies by a predetermined offset factor dF. Such sampling is also referred to as offset sampling hereinafter. The offset factor is selected to position a first overlapping spectral repetition at a point where aliasing has minimal or no influence on the application, such as coin detection. In other words, such an offset sampling has the effect of interlacing the Fourier series coefficients in the frequency domain and preventing an overlap due to aliasing until a desired location in frequency.

Further, in an implementation, the offset factor is determined based on an aliasing factor K, which is in turn determined by a level of acceptable aliasing. It will be understood that the level of aliasing acceptable in the application depends on the application and hardware/software limitations. For example, if the application is coin detection, the aliasing factor K may be 5, which means that a first overlapping spectral repetition occurs at a point defined by the aliasing factor K=5, and the sampling frequency.

In an embodiment, the handling apparatus includes a digital signal processing module to convert samples or sampled signals, received from the offset sampling module, into one or more frequency domain signals. The frequency domain signal includes frequency bins spaced at intervals defined by the aliasing factor K.

Furthermore, according to an embodiment, the handling apparatus includes an authentication unit configured to classify an inserted item of value by determining at least one characteristic property, for example an electromagnetic property, of the item of value based at least on the frequency domain signals obtained via offset sampling. It will be appreciated that due to offset sampling, the characteristic properties can now be evaluated before the first overlapping spectral repetition. As a result, the classification of the item of value can be performed with minimal or no aliasing and quantization noise.

While aspects of the described classification of the item of value can be implemented in any number of different systems, environments, and/or configurations, the embodiments are described in the context of the following exemplary system(s). The descriptions and details of well-known components are omitted for simplicity of the description. It will be appreciated by those skilled in the art that the words during, while, and when as used herein are not exact terms that mean an action takes place instantly upon an initiating action but that there may be some small but reasonable delay, such as a propagation delay, between the initial action, and the reaction that is initiated by the initial action.

FIG. 1 illustrates a handling apparatus 100 having an offset sampling module 102, according to an implementation of the present subject matter. The handling apparatus 100 can be implemented within an automatic transaction machine (ATM), a pay phone, a gaming machine, a kiosk, a bill acceptor, or a vending machine. In one implementation, handling apparatus 100 can be any hardware or software or any combination thereof, which may be configured to classify one or more items of value 104, such as currency, coupons, checks, tokens, gaming chips, security documents, banknotes, coins, vouchers, and the like. The classification of item of value 104 includes, but is not limited to, recognition, verification, validation, authentication, non-destructive testing, and determination of value or denomination of item of value 104. In another implementation, the handling apparatus 100 can be implemented within any computing device, such as a handheld device, laptop, and a desktop computer configured to sample one or more signals for a variety of applications known in the art.

In one embodiment, handling apparatus 100 may include an input 106 for receiving one or more items of value 104. Optionally or additionally, handling apparatus 100 may include an output 108 for ejecting item(s) of value 104. Additionally, handling apparatus 100 includes a central processing unit 110, hereinafter referred to as processor 110, and a memory 112. Processor 110 can be a single processing unit or a combination of multiple processing units. Processor 110 may be implemented as one or more microprocessors, microcomputers, microcontrollers, digital signal processors, central processing units, state machines, logic circuitries, and/or any devices that manipulate signals based on operational instructions. Among other capabilities, processor(s) 110 is configured to fetch and execute computer-readable instructions stored in the memory 112.

Memory 112 may include any computer-readable medium known in the art including, for example, volatile memory such as SRAMs and DRAMs and/or non-volatile memory such as EPROMs and flash memories. Memory 112 includes module(s) 114 and data 116. In one implementation, the module(s) 114 include offset sampling module 102, an authentication module 118, a clock generator module 120, a drive signal module 122, a digital signal processing (DSP) module 124, an anti-aliasing module 126 and other module(s) 128. It will be appreciated that each of the module(s) 114 can be implemented as a combination of one or more different modules. For example, offset sampling module 102 and anti-aliasing module 126 may be included within a single modification module (not shown in the figure). Other module(s) 128 include programs that supplement applications or functions performed by handling apparatus 100. Data 116 serves, amongst other things, as repository for storing data pertinent to functioning of modules 114.

In operation, handling apparatus 100 performs classification of the item of value 104, such as currency, tokens, etc., inserted into handling apparatus 100. To this end, handling apparatus 100 may include one or more sensors (not shown), for example electromagnetic sensors, optical sensors, impact sensors, and acoustic sensors. Handling apparatus 100 is hereinafter explained with reference to electromagnetic sensors; however, it will be understood that handling apparatus 100 can be configured to work with other sensors as well. Typically, an electromagnetic sensor includes at least one coil (not shown) arranged in proximity to a path of the item of value 104, such as a coin.

In one implementation, drive signal module 122 generates and applies a drive signal to the coil of the electromagnetic sensor. Drive signal module 122 may include a random generator (not shown in the figure), such as a pseudo-random binary sequence generator, to generate drive signal. In one example, drive signal is a periodic signal such as a stepwise periodic signal having multiple pulses with randomly selected intervals between signal transitions. It will be appreciated that the term "random" includes, without limitation, not only purely random, non-deterministically generated signals, but also pseudo-random and/or deterministic signals such as the output of a shift register arrangement provided with a feedback circuit to generate pseudo-random binary signals, and chaotic signals. Further, a bi-polar periodic drive signal eliminates DC offset and reduces wasted energy. The drive signal may take any shape, e.g. triangular, as long as a sufficiently wide spectrum of frequencies is contained within drive signal. In another example, the periodic signal can be a continuous signal. Additionally, the drive signal may be periodic even if it includes predefined buffer time intervals or idle time intervals to enable a steady state operation. The idle time slots may be periodic as well. Such a periodic signal may also be helpful in applications that involve two coils and where the two coils need to be energized individually with minimal or no interaction between each other. The idle time intervals in such applications enable a first coil to get de-energized before the second coil is energized, making the overall system appear periodic.

In one implementation, drive signal module 122 can modify properties of the drive signal, such as periodicity (T), number of pulses in each second (N), pulse width ($t_p$), etc., in coordination with clock generator module 120. In one example, properties of the drive signal may be varied, e.g., in real time, based at least on item of value 104 under inspection or on a range of frequencies in a sampled spectrum desired for inspection of item of value 104. In another example, pulse width $t_p$ and number of pulses N may be a function of a clock period ($t_c$) of a clock signal provided to processor 110 by clock generator module 120. The relationships can be expressed as follows:

$$t_P = L * t_c \tag{1}$$

Where L is an integer.

As previously described, drive signal module 122 applies the drive signal to the sensor's coil at pre-configurable time intervals, for example every 1 ms. When the drive signal is applied to the coil, the coil generates a varying magnetic field. The varying magnetic field introduces eddy currents in item of value 104, such as a coin, passing through a designated coin path. In turn, eddy currents induced inside item of value 104 modify an electrical impedance of item of value 104, referred to as $Z_{COIL}$. The modified electrical impedance $Z_{COIL}$ is helpful in classifying item of value 104. The modified electrical impedance $Z_{COIL}$ is determined by analyzing the variations in amplitude and phase of one or more sensor output signals. The sensor output signals are obtained at a sensor output terminal (not shown) when item of value 104 passes through sensor. It will be understood that the sensor output signal (voltage signal and/or current signal) is periodic with time period T, the same as that of the drive signal.

In one implementation, offset sampling module 102 samples the sensor output signal in response to an offset sampling signal, thereby generating a sampled signal. In one implementation, the offset sampling module samples the sensor output signal and the drive signal with a sampling period that is a non-integer multiple of the sampled signal's period so that a sampling location in time moves relative to the sampling signal's period.

In an implementation, the offset sampling module 102 samples the sensor output signal at a sampling frequency ($F_s$), which is offset from a fundamental frequency of the sensor output signal ($F_o$) by an offset factor dF (see equations 1-3). Similarly, the offset sampling module 102 samples the drive signal at a sampling frequency that is offset from the fundamental frequency of the drive signal by an offset factor dF. Offset factor dF helps to delay the aliasing due to overlapping of Fourier series coefficients of fundamental frequency with the Fourier series coefficients of a subsequent harmonic frequency up to a point where aliasing is no longer critical to the application. In one implementation, the offset factor dF can be determined by selecting an aliasing factor K, which can be obtained by looking at the aliasing profile and the amount of aliasing that an application, say coin sensing, can afford. For example, K can be chosen to be 5 so that at the $5^{th}$ spectral repetition, in other words at $5*(F_s)$, the aliased Fourier series coefficients of the harmonic frequencies overlap with the coefficients of the fundamental frequency. By delaying the spectral overlap due to aliasing until the $5^{th}$ spectral repetition, the error in the signal relevant to the coin sensing, is significantly reduced. The $5^{th}$ spectral repetition in this case is referred to as the first overlapping spectral repetition.

The relationships between the offset factor and sampling frequency are provided below:

$$F_o = \frac{1}{N * t_p} \tag{2}$$

$$F_s = (M * F_o) \pm dF \tag{3}$$

$$t_s = \frac{1}{F_s} \tag{4}$$

Where, $F_o$=frequency of the signal under consideration, where the signal is, for example, a periodic stepwise signal.

M=sampling factor

N=number of pulses in the drive signal

M/N ratio=number of samples per pulse. In the simplest case, sampling factor M=1 in accordance with the Nyquist theorem.

$t_s$=sampling period

Sampling period, or $t_s$, may also be based on time period of the clock signal, e.g., $$t_s = Q * t_c \tag{5}$$

Where Q is an integer.

Offset factor dF is given by equation 4, which shows the inverse relationship between an aliasing factor K and offset factor dF.

$$dF = \frac{F_o}{K} \tag{6}$$

From equations (2), (3), (4), and (6), sampling frequency $F_s$ can also be given by:

$$F_s = \frac{K * M + 1}{K} * F_o \tag{7}$$

Thus, $$t_s = \frac{K * N}{K * M + 1} * t_p \tag{8}$$

In one implementation, one or more samples of the drive signal and the sensor output signal are captured and stored in data 116 at intervals equal to sampling period $t_s$. Further, numbers of samples L in each of the sampling periods $t_s$ are set to be an integer number of the sampled signal's period to avoid spectral leakage. The above mentioned capturing and storing of samples is done until the lapse of a window time period ($t_w$). In one implementation, window time period $t_w$ is based on the aliasing factor K, offset factor dF, and pulse width of the drive signal, i.e., $t_p$.

$$t_w = \frac{1}{dF} \tag{9}$$

$$t_w = K * N * t_p = (K * M + 1) * t_s \tag{10}$$

It can be understood from equations 9 and 10 that the sampled signal is K*M+1 samples long with K*N pulses of width $t_p$. In one implementation, pulse width $t_p$ and the sampling period $t_s$ are functions of processor clock period $t_c$ as shown in equations 1 and 2. Substituting Equation 1 and 2 in 10 yields:

$$Q * t_c = \frac{(K * N * L)}{K * M + 1} t_c \tag{11}$$

Therefore, Q=K*N and L=K*M+1

In one implementation, offset sampling module 102 computes Q and L based on the above relationships to provide a solution matching the system constraints on length and pulse width of the drive signal, in accordance with the processor design constraints.

Additionally, in an implementation, anti-aliasing module 126 may condition the sensor output signal and the drive signal prior to sampling. In one example, anti-aliasing module 126 may include a low-order filter, such as a second order filter, for said conditioning. In one implementation, the filter's parameters, such as complexity, can be configured in real-time through processor 110 based at least on the input signal, e.g. drive signal and sensor output signal. Alternatively, a look-up table may be provided to select a filter's parameters based at least on the input signal, processor 110, and application of the handling apparatus 100. In contrast to conventional solutions, the filters in such applications are designed to be high speed and high order complex filters with steep transition bands. However, due to the presence of offset sampling module 102, the sampled signal is substantially free of errors due to aliasing and thus, transition band requirements of anti-aliasing module 126 are dramatically reduced, and a relatively low order filter may be easily implemented. This helps in reducing the complexity and the cost of the handling apparatus 100.

Further, in one embodiment, digital signal processing (DSP) module 124 obtains samples or sampled signal from offset sampling module 102. Furthermore, DSP module 124 converts the samples from time domain to frequency domain by taking their Discrete Fourier Transform (DFT) or Fast Fourier Transform (FFT) at every $t_w$ seconds. If the number of sampled samples L in window time period $t_w$ are a power of two, FFT may be used. The frequency domain signal from DSP module 124 includes frequency bins spaced at K bin intervals, or K*dF Hz apart. It would be understood that in frequency domain, coefficients of the discrete Fourier series for the drive signal and the sensor output signal result in discrete frequencies that are enveloped by the sinc(x) waveform. In one implementation, the frequency domain signals and/or Fourier series coefficients thus obtained may be stored in data 116.

Furthermore, handling apparatus 100 also includes authentication module 118 for determining validity and denomination of one or more inserted items of value 104, such as currency, token, vouchers, etc, received from input 115. In one implementation, authentication module 118 analyzes the frequency domain signals obtained from DSP module 124 or stored in data 116, to compute properties of the inserted item of value 104. For example, authentication module 118 analyzes the frequency domain signals to characterize at least one characteristic property, for example change in electrical impedance due to the inserted item of value 104. Change in electrical impedance or differential impedance ΔZ can be given by the difference between the electrical impedance computed in presence of item of value 104, i.e., $Z_{COIN}(\omega)$, and in the absence of item of value 104 or in an "idle" state $Z_{AIR}(\omega)$ $$\Delta Z = Z_{COIN}(\omega) - Z_{AIR}(\omega) \tag{12}$$

In an implementation, the authentication module 118 receives the frequency domain signals from the DSP module 124 and improves the signal to noise ratio of the frequency domain signals, by (a) providing a transfer function model of the system or (b) implementing curve-fitting techniques. For example, the authentication module 118 can provide a continuous time transfer function model either: by modeling the current and voltage measurements separately and then taking, a ratio of the two models or by directly determining the transfer function and then evaluating the transfer function at selected frequency points using Levy's curve fitting method, vector fitting or the like. With the help of the transfer function model, R(w) and L(w) can be calculated for $Z_{COIN}(\omega)$ and $Z_{AIR}(\omega)$, and ΔR and ΔL can then be used for classification of the inserted item of value 104.

In another example, the authentication module 118 may implement curve-fitting techniques to model R(ω) and L(ω) and obtain known representative functions of known complexity such as polynomials, sum of exponential, etc, thereby providing less noisy estimates for the measurements.

The authentication module 118, in one implementation, classifies the inserted item of value 104 based on one or more classification techniques including, but not limited to, Mahalanobis distance, Linear Discriminant Analysis, Support Vector Machine, and Feature Vector Selection, applied on differential impedance ΔZ or ΔR and ΔL. In another example, mutual impedance can be used to classify the inserted item of value 104 in a manner described above.

It will be appreciated that, typically, sensing schemes operate on very small signal levels as such signals are not absolute signals but difference signals obtained in the idle state and in presence of item of value 104. Since, differential impedance ΔZ is typically very small, the process is highly sensitive to noise. This is also because differential impedance ΔZ is in the same order of magnitude as difference signals of interest. However, offset sampling module 102 allows for sampling by sampling frequency that is offset by offset factor dF, which in turn helps in reducing errors due to aliasing. As a result, differential impedance ΔZ calculated by equation 10 is substantially free of errors due to aliasing. Thus, authentication module 118 classifies items of value 104 more accurately than the conventional solutions. Further, frequencies in the main lobe of the sinc(x) waveform of the sensor output signal can be recovered with reasonable fidelity.

Figure 2A:
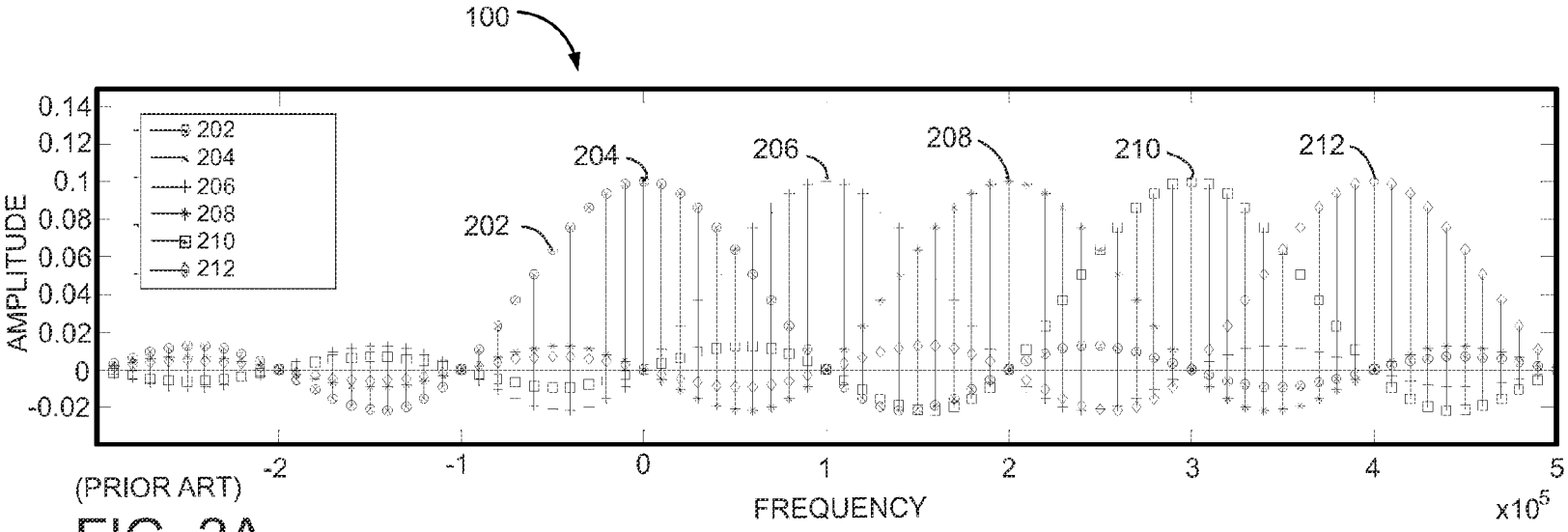
(PRIOR ART) FIG. 2A
FIGS. 2(*a*) and (*b*) illustrate aliasing in a conventional electronic transaction system.
Figure 2B:
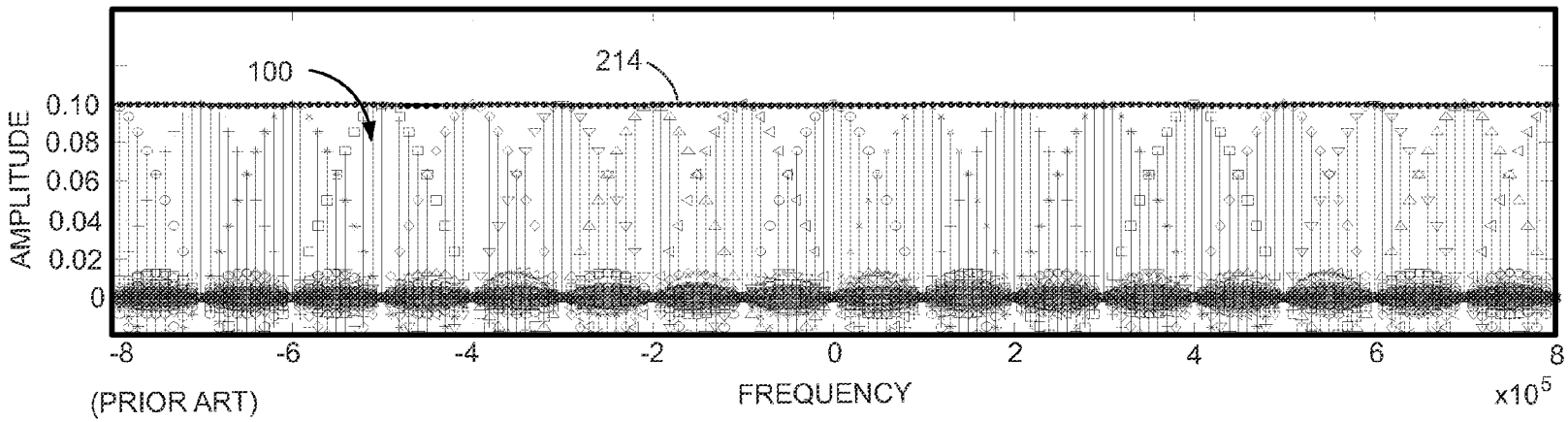
(PRIOR ART) FIG. 2B
Figure 3A:
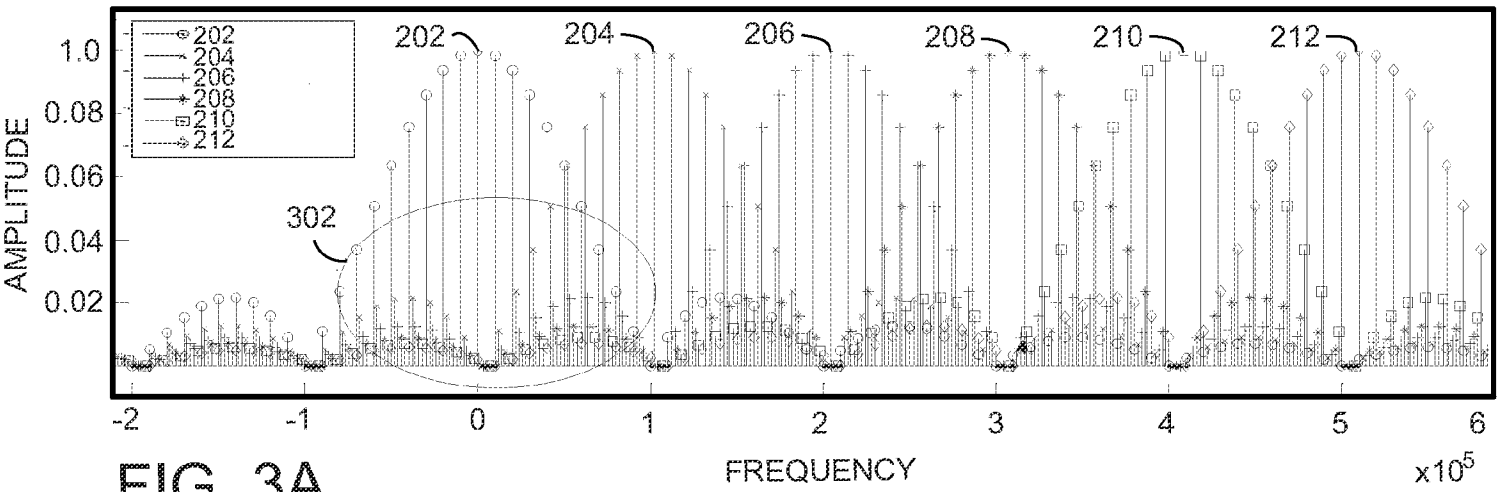
FIGS. 3(*a*), 3(*b*), 3(*c*), and 3(*d*) graphically illustrate the reduction in error due to aliasing, according to an embodiment of the present subject matter.
Figure 3B:
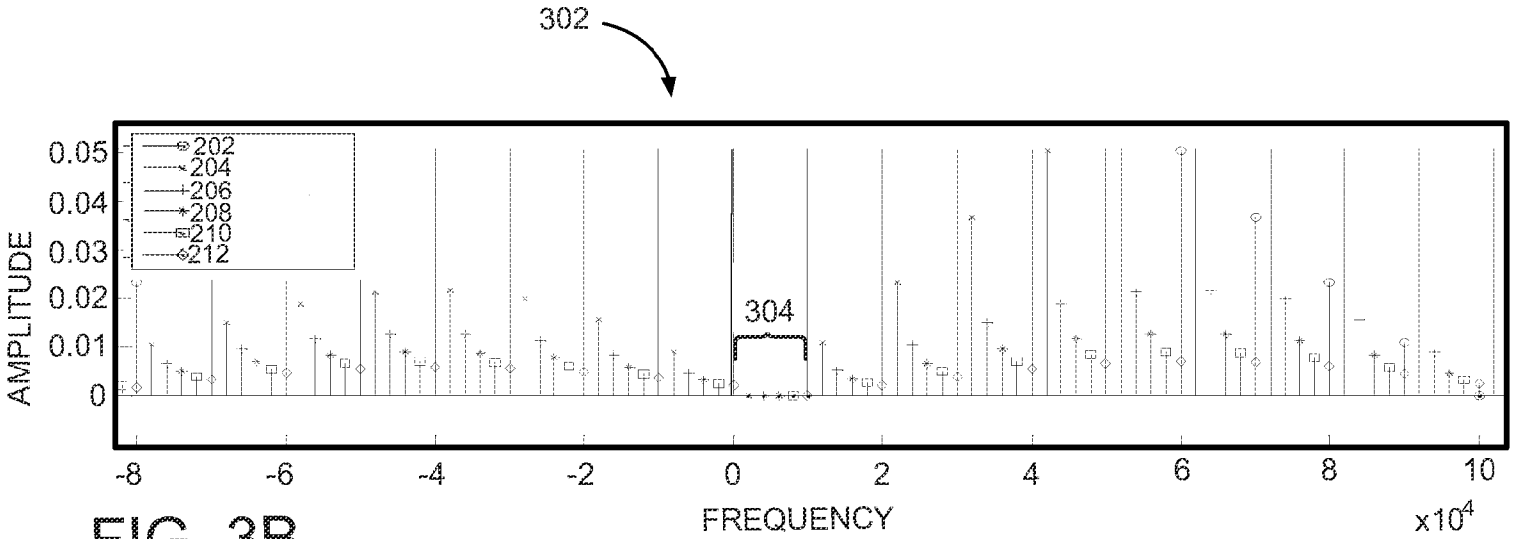
Figure 3C:
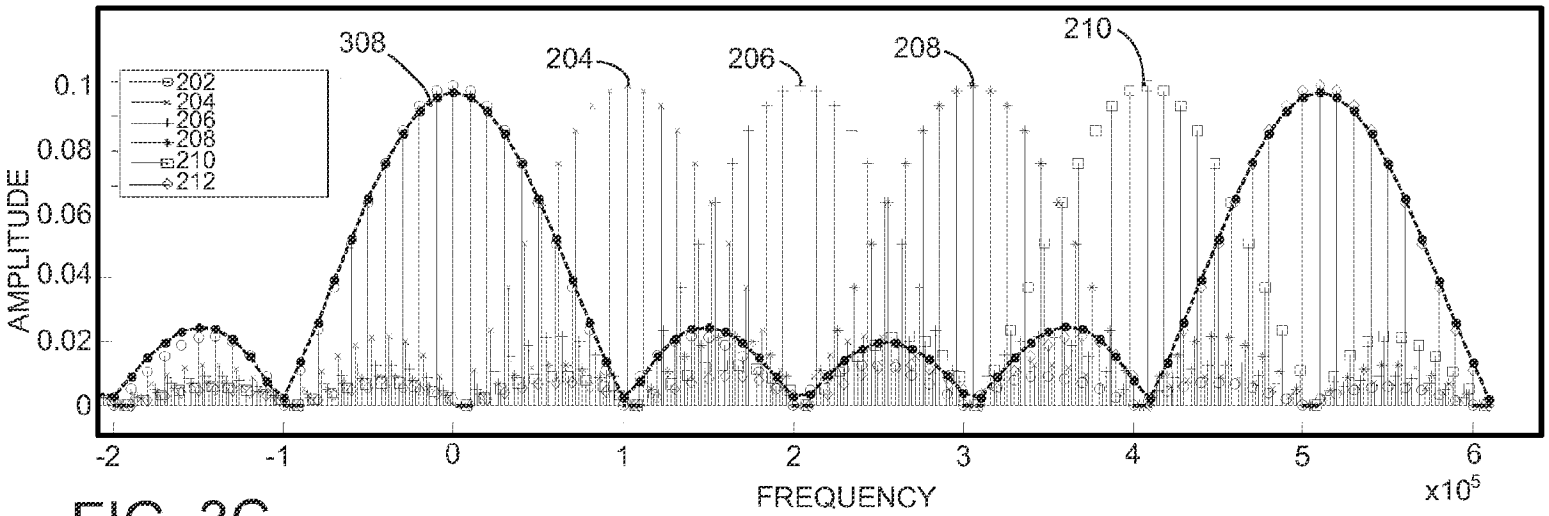
Figure 3D:
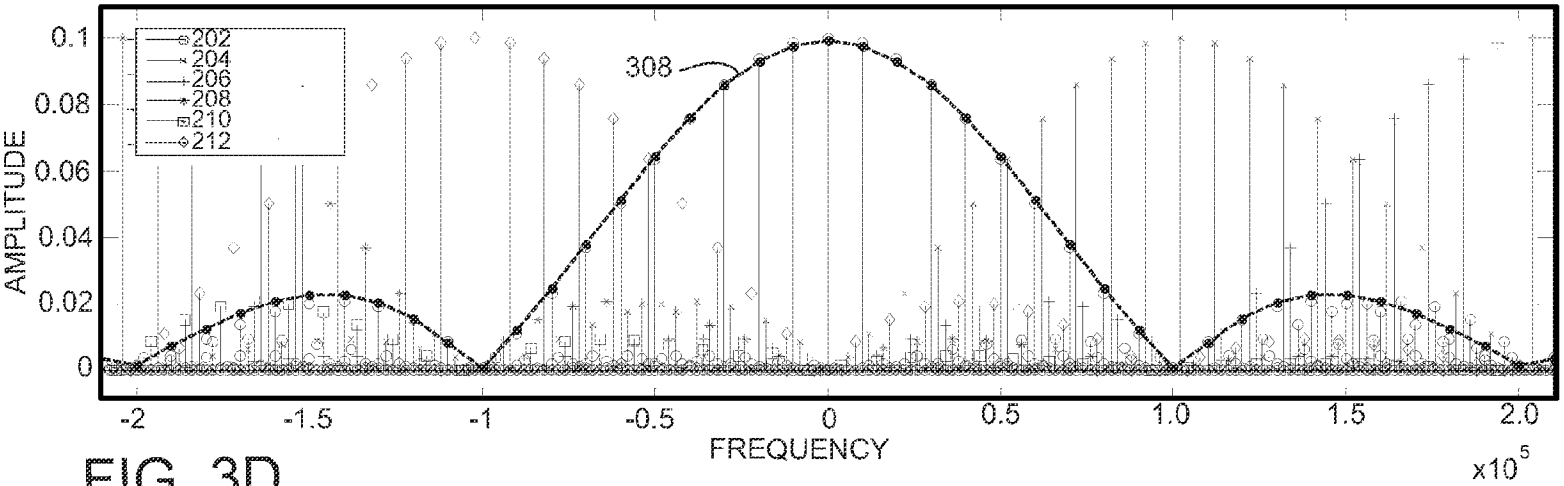

FIGS. 2(*a*), 2(*b*) and 2(*c*) illustrate the effects of aliasing with no offset sampling. Typically, when a drive signal and/or sensor output signal is sampled, a sampled signal 202 is obtained which is centered at $F_{sp}=0$. In frequency domain, the sampled signal 202 is expressed as:

$$H(n) = \frac{\tau}{T} * \frac{\sin((m * F_{sp} \pm n * F_o) * \Pi * \tau)}{(m * F_{sp} \pm n * F_o) * \Pi * \tau} \tag{13}$$

Where:

m= . . . , −2, −1, 0, 1, 2, . . . (used for images at integer multiples of the sampling frequency $F_{sp}$)

$F_{sp}$—frequency at which the drive signal, for example rectangular signal, is sampled $F_o$=fundamental frequency of the drive signal n= . . . , −2, −1, 0, 1, 2, . . . (used for harmonics at integer multiples of fundamental frequency of drive signal)

π=pulse width of each of the pulses in the drive signal

T=time period of the drive signal

In the above relationship, consider a case where $F_{sp}=F_o$ for positive integer multiples of $F_{sp}$. In such a case, the spectrum of the sampled signal 202 centered at $F_o=0$ gets corrupted with images at multiples of $F_{sp}$, as shown by curves 204, 206, 208, 210 and 212. For the sake of clarity, FIG. 2(*a*) only shows 5 positive image frequencies. The first image at $F_{sp}$ is represented by curve 204, second image at $2F_{sp}$ by curve 206, third image at $3F_{sp}$ by curve 208, fourth image at $4F_{sp}$ by curve 210, and the fifth image at $5F_{sp}$ is shown by curve 212.

In other words, spectrum of the sampled signal 202 repeats at multiples of the sampling frequency $F_{sp}$ such as $F_{sp}$, $2F_{sp}$, $3F_{sp}$, and so on. As a result, errors due to aliasing are introduced. Further, it can be observed that the main lobe of the first image 204 centered at $F_{sp}$=100 KhZ overlaps with the main lobe of the sampled signal 202, adding significant error to the sampled signal 202. Similarly, as shown in FIG. 2(*a*), the other images at $2F_{sp}$, $3F_{sp}$, etc., also contribute to the error due to aliasing, albeit at lesser levels.

A resulting spectrum 214 obtained by a summation of all the contribution from the images shown by curves 204-212 is illustrated in FIG. 2(*b*). In FIG. 2(*b*), the resulting spectrum 214 is shown to contain negative frequencies to mitigate the edge effects due to DFT.

As shown in FIG. 2(*b*), the sampled signal 202 may be unrecoverable from the resulting spectrum 214. As known in the art, effects of aliasing can be mitigated either by band-limiting the sampled signal via filtering or/and by sampling well above the Nyquist rate. However, as mentioned earlier, due to the nature of signals dealt with in applications such as classification of items of value 104, filtering and oversampling would both be cost-prohibitive. Additionally, high order anti-aliasing filtering would be required, as well as the ADCs with sampling rates well above those commonly available in microprocessors today.

To this end, handling apparatus 100 with offset sampling module 102 introduces an offset factor dF in the sampling frequency $F_{sp}$ to mitigate aliasing considerably. FIGS. 3(*a*), 3(*b*), and 3(*c*) illustrate the removal of aliasing errors, due to offset sampling, according to an implementation of the present subject matter.

FIG. 3(*a*) shows that coefficients due to first image 204 do not overlap with coefficients of the sampled signal 202, according to an implementation of the present subject matter. Similarly, there is no overlap between coefficients of the sampled signal 202 and other images represented by 206, 208, 210 and 212. This is further illustrated in a zoomed plot of region 302 in FIG. 3(*b*). According to an implementation, separation of the frequency bins between images is equal to dF, or in this case 2 kHz apart. Since, K has been chosen to be 5 in this example, it can be seen that at the $5^{th}$ spectral repetition, in other words at $5*(F_{sp}+dF)$, the aliased Fourier series coefficients of the images 204 to 212 overlap with the sampled signal 202 in region 304. It should be understood that although overlap occurs on the $5^{th}$ aliased image, contribution of the aliased image is significantly reduced due to decaying nature of sin(x)/x nature of the sampled signal 202 in frequency domain. The signal spectrum can now be recovered as shown by the solid curve 306 in FIG. 3(*c*). The solid curve 306 is sum of Fourier coefficients of every $K^{th}$ imaged frequency since these alias back and overlap the fundamental frequency bins. It will be appreciated that the reduction in aliasing error is in part due to the offset sampling and may be used in various applications without the need for high-speed or high order ADC or any filtering.

However, for other applications that require an even better fidelity, an anti-aliasing module 126 may be used. In one embodiment, anti-aliasing module 126 implements a low order filter, for example a second order filter, at a cutoff frequency of say $F_s/2$ on resultant signal spectrum. Due to offset sampling, the transition band requirements of the filter in anti-aliasing module 126 are dramatically reduced, and a low order filter may suffice. As shown in FIG. 3(*d*) by solid curve 308, the anti-aliasing module 126 further reduces the error due to offset sampling alone by about 35% if a second order filter is used, and about 50% if a fourth order filter is used. It will be understood by a person skilled in the art that the percentage decrease depends on a number of factors such as application and processor specifications.

Figure 4:
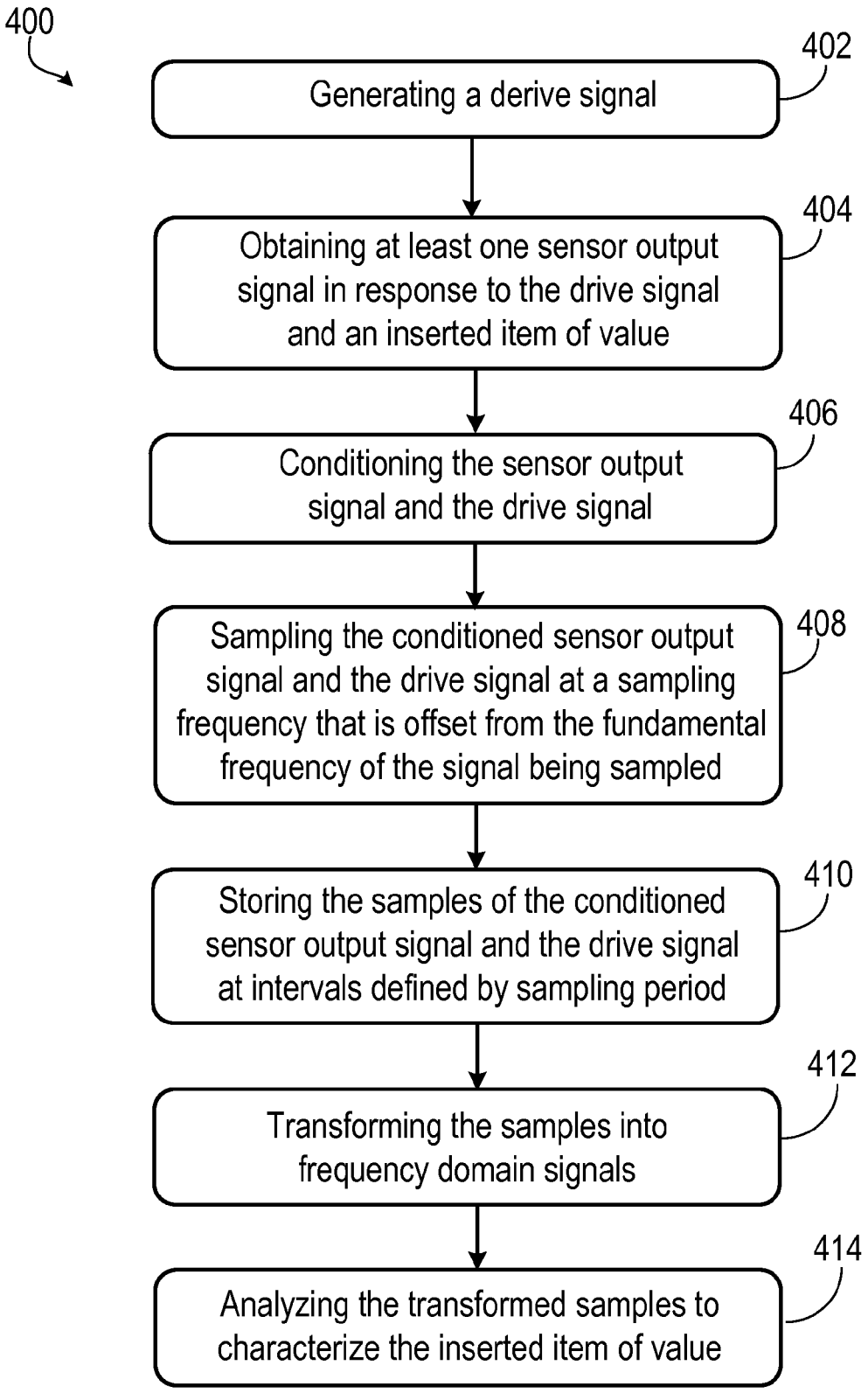
FIG. 4 illustrates an exemplary method for classifying the items of value, in accordance with an embodiment of the present subject matter.

FIG. 4 illustrates an exemplary method 400 for characterizing an item of value 104, such as coin inserted in a handling apparatus, in accordance with an embodiment of the present subject matter. Method 400 is described in the context of electromagnetic sensors; however, method 400 may be extended to cover other kinds of sensors. Additionally, even though the method is described in the context of handling apparatus 100 within an electronic transaction system for classification of an item of value 104, the method is also implementable on other applications as will be understood by a person skilled in the art. Herein, some embodiments are also intended to cover program storage devices, for example, digital data storage media, which are machine or computer readable and encode machine-executable or computer-executable programs of instructions, wherein said instructions perform some or all of the steps of the described method. The program storage devices may be, for example, digital memories, magnetic storage media such as a magnetic disks and magnetic tapes, hard drives, or optically readable digital data storage media.

The order in which the method is described is not intended to be construed as a limitation, and any number of the described method blocks can be combined in any order to implement the method, or an alternative method. Additionally, individual blocks may be deleted from the method without departing from the spirit and scope of the subject matter described herein. Furthermore, the method can be implemented in any suitable hardware, software, firmware, or combination thereof At block 402, a drive signal is generated. In an example, drive signal generation module generates the drive signal, for example a bipolar periodic signal with randomly selected intervals between signal transitions. In one implementation, properties of the drive signal, such as $t_p$, N, T, etc., may be configured based on an inserted item of value 104 and/or processor 110. For example, assuming the clock of the processor 110 at 72 MHz, the system clock period is then $t_c$=1/72=13.89 nsec Using equation 11 and setting M=N for one sample, and choosing L=256 gives Q=255. Further, by equation 11, K=5 and N=51. Thus, the sequence is 51 pulses long and aliasing factor K is 5. The minimum pulse width $t_p$ can be calculated as 3.556 microseconds. The minimum pulse width $t_p$ sets the zero crossings of the sinc pulse at 281.25 kHz.

In one example, the drive signal is applied to an element of a sensor, such as a coil of an electromagnetic sensor. As a result, the coil generates a varying magnetic field.

At block 404, at least one sensor output signal is obtained in response to the drive signal and inserted item of value 104. For example, when the inserted item of value 104 passes through varying magnetic field, one or more sensor output signals are obtained. The sensor output signals contain information pertinent to inserted item of value 104 and are helpful in characterizing item of value 104. One of the ways to do so is convert such signals into frequency domain with minimal aliasing and noise.

At block 406, the sensor output signal and the drive signal are conditioned by an anti-aliasing module. For example, anti-aliasing module 126 having a low order filter may be implemented for conditioning the sensor output signal and the drive signal. The conditioning includes filtering, amplifying, converting, and any other process suitable for processing the signal.

At block 408, the sensor output signal and the drive signal are sampled at an offset sampling frequency $F_s$. For example, offset sampling module 102 determines a sampling signal based on properties of the sensor output signal and an aliasing factor K. The aliasing factor K, in one implementation, dictates the distance of the first overlapping spectral repetition. The aliasing factor K is based at least on an aliasing profile and a level of aliasing acceptable in an application. In one example, the aliasing profile provides information on the aliasing obtained in a conventional set-up with known items of value 104. Alternatively or additionally, the aliasing profile may be obtained from historical data. Such an aliasing profile helps in determining the level of aliasing that an application can afford. Accordingly, the aliasing factor K helps to push the first overlapping spectral repetition to a point at which aliasing is non-critical to the application.

For example, the first overlapping spectral repetition occurs at a lapse of window time period $t_w$, given by $K*F_s$. Further, in one implementation, the number of samples in each window time period, i.e. L, may be set to be an integer number of the sampling signal to avoid spectral leakage.

Using equations 5 and 10, sampling time period $t_s$ is given by $t_s$=3.542 useconds and $F_s$=282.35 kHz. and $t_w$=906.667 usecs. Furthermore, using equations 2 and 6, Frequency of the drive signal is then $F_o$=5.515 kHz. Offset factor dF, and thus the separation of the aliased frequency bins is dF=1.103 kHz. As a result, the first overlapping spectral repetition occurs at Rep1=$K*F_s$=1.412 MHz.

At block 410, samples are stored at intervals defined by sampling period. Such samples are stored up until the lapse of window time period $t_w$. Thus, a total of L samples are stored in the data 116.

At block 412, the stored samples are transformed into frequency domain. In one implementation, DSP module 124 transforms the samples into frequency domain signals by DFT, FFT, or any other technique known in the art.

For example, if L is a power of two, FFT can be used. Further, if K=5, the frequency bins of interest after FFT are spaced at 5 bin intervals or 5*dF Hz apart. In other words, with K=5, frequency bins 1, 6, 11, etc. contain the frequencies of interest, while the bins in between contain the aliased frequencies. In one implementation, for applications such as coin sensing, coin detection, etc., frequencies up to Fs/2=141.18 kHz may be used.

At block 414, the transformed samples are analyzed to characterize inserted item of value. In one implementation, the transformed samples are analyzed to determine one or more properties of the inserted item of value 104. For example, the transformed samples obtained in response to an inserted coin can be used to determine differential electrical impedance ΔZ. In another implementation, the transformed samples can be used to determine differential electrical resistance or inductance. Further, the differential electrical impedance ΔZ can be used to classify the inserted coin on the basis of various classification techniques known in the art. Before applying classification techniques, the signal to noise ratio can be further improved either by modeling the transfer function of the system or by implementing curve fitting techniques to model the R(w) and L(w) with functions of known complexity.

The measurement and analysis of ΔZ via conventional time domain models is extremely complex and computationally extensive. Thus, instead of using electronic oscillator circuits and analyzing the changes in frequency and amplitude of the idle oscillator signal in the present of an item of value 104, an actively driven periodic pulse train or drive signal is used to drive an inductor. The voltage and the current changes across the inductor are measured in the presence of the item of value 104, which in turn gives the differential electrical impedance. In an implementation, since the inductance is actively driven by a pseudo random binary sequence, the impedance changes can be measured as a function of frequency, across a wide range of frequencies, instead of a single frequency.

Further, due to offset sampling implemented at block 408, the classification of the inserted item of value is much more accurate than before. Additionally, the quantization noise and error due to aliasing is substantially reduced. The amount of reduction in error due to aliasing depends at least on the application and the amount of aliasing an application can afford.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although embodiments for a system to classify items of value have been described in language specific to structural features and/or methods, it is to be understood that the invention is not necessarily limited to the specific features or methods described. Rather, the specific features and methods are disclosed as exemplary embodiments for the system to classify the items of value.

What is claimed is:

1. A handling apparatus, comprising:

an input configured to receive an item of value;

at least one sensor comprising an element, the at least one sensor configured to produce a sensor output signal in relation to the item of value; and a processor configured to:

provide a drive signal to the element of the at least one sensor, wherein the drive signal causes the at least one sensor to produce the sensor output signal;

provide a sampled signal by sampling one or more of the drive signal and the sensor output signal at a sampling frequency that is offset from a fundamental frequency by an offset factor;

convert the sampled signal into a frequency domain signal; and classify the item of value based on the frequency domain signal.

2. The handling apparatus as claimed in claim 1, wherein the at least one sensor is configured to produce the sensor output signal when the item of value passes through a magnetic field of the at least one sensor.

3. The handling apparatus as claimed in claim 2, wherein the drive signal is a periodic signal with predetermined buffer time intervals to reach a steady state.

4. The handling apparatus as claimed in claim 2, wherein the at least one sensor is configured to:

receive the drive signal; and provide the sensor output signal in response to the item of value inserted into the handling apparatus.

5. The handling apparatus as claimed in claim 1, wherein the processor is further configured to:

determine at least one characteristic property of the inserted item of value based at least on the frequency domain signal, wherein the inserted item of value is classified based on the determination.

6. The handling apparatus as claimed in claim 5, wherein the processor is further configured to implement one of Mahalanobis distance, Feature Vector Selection, and Linear Discriminant Analysis to classify the inserted item of value.

7. The handling apparatus as claimed in claim 5, wherein the processor is further configured to perform curve fitting on the frequency domain signal.

8. The handling apparatus as claimed in claim 5, wherein the processor is further configured to:

obtain at least one of electrical impedance, resistance and inductance based on the frequency domain signal; and model at least one of the electrical impedance, the resistance and the inductance to provide a transfer function, wherein the transfer function is used to classify the inserted item of value.

9. The handling apparatus as claimed in claim 5, wherein the processor is configured to provide a transfer function and evaluate the transfer function at selected frequency points to classify the item of value.

10. The handling apparatus as claimed in claim 5, wherein the item of value is at least one of a banknote, a bill, a coupon, a security paper, a check, a valuable document, a coin, a token, and a gaming chip.

11. The handling apparatus as claimed in claim 1, wherein the processor is further configured to condition the signal.

12. The handling apparatus as claimed in claim 1, wherein the processor comprises at least one filter, wherein complexity of the filter is configured based at least on the processor and an application of the handling apparatus.

13. The handling apparatus as claimed in claim 1, wherein the offset factor is selected such that a first overlapping spectral repetition occurs at a point defined by an aliasing factor and the sampling frequency.

14. The handling apparatus as claimed in claim 13, wherein the sampling frequency is based at least on the aliasing factor and a clock period of the processor.

15. The handling apparatus as claimed in claim 13, wherein the aliasing factor is based at least on an aliasing profile and a measure of aliasing acceptable to an application.

16. The handling apparatus as claimed in claim 1, wherein the handling apparatus is implemented in one of a vending machine, an automatic teller machine, a gaming machine, a currency validator, and a bill validator.

17. The handling apparatus as claimed in claim 1, wherein the handling apparatus is implemented in one of a pay phone, a computer, and a hand-held device.

18. The handling apparatus as claimed in claim 1, wherein the processor is further configured to configure one or more properties of the drive signal, wherein the properties are periodicity, number of pulses in each second, and pulse width.

19. A method comprising:

receiving an item of value through an input in a handling apparatus, wherein the handling apparatus comprises at least one sensor;

providing a drive signal to an element of the at least one sensor, wherein the drive signal causes the at least one sensor to produce a sensor output signal;

sampling one or more of the drive signal and a sensor output signal at a sampling frequency to provide a sampled signal, wherein the sampling frequency is offset from a fundamental frequency by an offset factor;

transforming the sampled signal into a frequency domain signal; and classifying the item of value based on the frequency domain signal.

20. The method as claimed in claim 19, wherein the at least one sensor is configured to produce the sensor output signal when the item of value passes through a magnetic field of the at least one sensor.

21. The method as claimed in claim 20, further comprising:

obtaining the sensor output signal in response to the drive signal and an item of value inserted into a handling apparatus; and conditioning at least one of the sensor output signal and the drive signal.

22. The method as claimed in claim 20, wherein the drive signal is a periodic signal with predetermined buffer time intervals to reach a steady state.

23. The method as claimed in claim 19, further comprising determining at least one characteristic property of an inserted item of value from the frequency domain signal.

24. The method as claimed in claim 23, wherein the property is differential impedance determined based on a difference between an impedance in presence of the inserted item of value and an impedance in absence of the inserted item of value.

25. The method as claimed in claim 23, wherein determining comprises classifying the inserted item of value for one of authentication, recognition, testing, recognition, verification, validation, and determination of value of the item of value.

26. The method as claimed in claim 23, wherein determining comprises implementing a curve fitting technique to classify the inserted the item of value.

27. The method as claimed in claim 23, further comprising implementing one of Mahalanobis distance, Feature Vector Selection, and Linear Discriminant Analysis to classify the inserted item of value.

28. The method as claimed in claim 23, wherein determining the at least one characteristic property of the inserted item of value from the frequency domain signal comprises obtaining a transfer function model to classify the inserted item of value.

29. The method as claimed in claim 28, wherein determining the at least one characteristic property of the inserted item of value from the frequency domain signal comprises evaluating the transfer function model at specified frequency points to classify the inserted item of value.

30. The method as claimed in claim 28, further comprising obtaining the transfer function model by one of a vector fitting technique and Levy's curve-fitting method.

31. The method as claimed in claim 19, wherein the offset factor is selected such that a first overlapping spectral repetition occurs at a point defined by an aliasing factor and the sampling frequency.

32. The method as claimed in claim 31, wherein the aliasing factor is based at least on an aliasing profile and a measure of aliasing acceptable in an application.

33. The method as claimed in claim 31, wherein the sampling frequency is based in part on a clock period of a processor and in part on the aliasing factor.

34. The method as claimed in claim 19, wherein the method is implemented in one of a vending machine, an automatic teller machine, a gaming machine, a currency validator, a pay phone, a computer, and a hand-held device.

35. A method comprising:

determining an aliasing profile;

determining a level of aliasing acceptable in an application based on the aliasing profile;

determining an aliasing factor based on the level of acceptable aliasing;

receiving an item of value through an input in a handling apparatus, wherein the handling apparatus comprises at least one sensor;

providing a drive signal to an element of the at least one sensor, wherein the drive signal causes the at least one sensor to produce a sensor output signal;

sampling one or more of the drive signal and a sensor output signal at a sampling frequency to provide a sampled input signal, wherein the sampling frequency is offset from a fundamental frequency by an offset factor, and wherein the offset factor is based at least on the aliasing factor;

converting the sampled input signal into a frequency domain signal; and classifying the item of value based on the frequency domain signal.

36. The method as claimed in claim 35, wherein the frequency domain signal is used to provide a transfer function model.

37. The method as claimed in claim 36, wherein the transfer function model is obtained using Levy's curve fitting method.

38. The method as claimed in claim 35, wherein a curve fitting technique is implemented on the frequency domain signal to reduce signal to noise ratio.

39. A system, comprising:

a memory element; and one or more processors coupled to the memory element, the one or more processors configured to:

determine an aliasing profile;

determine a level of aliasing acceptable in an application based on the aliasing profile;

determine an aliasing factor based on the level of acceptable aliasing;

receive an item of value through an input in a handling apparatus, wherein the handling apparatus comprises at least one sensor;

provide a drive signal to an element of the at least one sensor, wherein the drive signal causes the at least one sensor to produce a sensor output signal;

sample one or more of the drive signal and a sensor output signal at a sampling frequency to provide a sampled input signal, wherein the sampling frequency is offset from a fundamental frequency by an offset factor, and wherein the offset factor is based at least on the aliasing factor;

convert the sampled input signal into a frequency domain signal; and classify the item of value based on the frequency domain signal.

* * * * *